US005913545A

United States Patent [19]

Everingham, Jr.

[11] Patent Number: 5,913,545

[45] Date of Patent: Jun. 22, 1999

[54] KNOT TIGHTENING TOOL

[76] Inventor: Roy R. Everingham, Jr., 15391 Lazy Creek Rd., El Cajon, Calif. 92021-6018

[21] Appl. No.: 08/848,471

[22] Filed: May 8, 1997

[51] Int. Cl.[6] ..... B65H 69/04

[52] U.S. Cl. ..... 289/17; 254/248

[58] Field of Search ..... 289/17, 18.1, 2, 289/13; 87/53, 62; 140/123, 123.5, 93.2, 101; 254/237, 199, 243, 248, 249, 250, 251

[56] References Cited

U.S. PATENT DOCUMENTS

| | | | |
|---|---|---|---|
| 141,255 | 7/1873 | Bean | 254/249 |
| 679,870 | 8/1901 | Stoddard | 254/248 |
| 1,351,598 | 8/1920 | Wise | 140/121 |
| 1,430,623 | 10/1922 | Campbell | 140/123.5 |
| 1,488,043 | 3/1924 | Goodman | 254/237 |
| 1,553,110 | 9/1925 | Rich | 81/9.3 |
| 3,330,309 | 7/1967 | Horvath, Jr. | 140/121 |

*Primary Examiner*—Michael A. Neas

*Attorney, Agent, or Firm*—Brown, Martin, Haller & McClain

[57] ABSTRACT

A knot tightening tool for use in mending or making a fishing net, which fishing net has a heavy rope or the like to which a flexible line such as a cord line is secured by a knot around the rope. The knot tightening tool has a pair of handles aligned in the same plane with end portions adjacent the rope and being interconnected by cross links such that rotation of the grip ends of the handles causes the end portions to move apart. Each end portion has gripping jaws that grip the free ends of the line and in the opposing movement pulls the free ends of the line, tightening the knot.

5 Claims, 2 Drawing Sheets

KNOT TIGHTENING TOOL

BACKGROUND OF THE INVENTION

This invention concerns a hanging knot tightening tool for use in mending or making fishing nets and the like. Fishing nets generally comprise a large rope or lead line or cork line to which flexible lines that make up hangings are secured to extend laterally and connect the net to the lead line or cork line. The net is thus connected to the hangings along the length of the rope by hanging knots that secure the hangers to the rope.

In making or repairing a net, the general procedure is to use a needle or the like that is connected to the end of a line. The needle is used to build hangers, a knot, a slack loop and another knot and loop continuously full length of the net on cork line and lead line. The knots are then tightened by the tool into a knot. The knot secures and holds the hanging line to an approximate 6"–8" spaced location on the rope, the net along the length of the rope, which allows the net to maintain it's ratio of slack netting to rope. It may be understood that it is essential if not mandatory that the knots be tightened in a manner that they do not slip on the line, because slipping can cause the net-to-rope ratio to change causing tearing of the net. The line is tied by knots to the rope by looping the line around the rope and by pulling on the free ends of the line to tighten the rope sufficiently so that the knots will not become loose. The procedure for this is to either jerk the free ends of the lines by yanking the needle, or by having two persons grasp each free end of the line and jerking it. This is very damaging to the user's hands, which can result in a poor and unserviceable knot.

The rope used is flexible and to some extent compressable, and accordingly it is not easy to make an acceptable knot by just yanking on the ends of the line. So in some instances, the free ends of the lines are wrapped around a bar and several deck hands then step on the lead line or cork line and yank on the bar or bars to tighten the knot. Further, there are known tools that comprise a rod or shaft having a gripping handle on one end and a head portion on the other end, with the head portion having a gripper for gripping one free end of the line for pulling on the line and tightening the knot. These grippers are characterized by fitting against the rope or houser with one on each side. The head portion has a circular recess for fitting around a portion of the side of the rope. With such a tool handled by two persons on opposite sides of the rope, and grasping opposite free ends of the line making the knot, allows the line to be pulled in opposite directions tightening the knot to the extent possible and allowed by the tool or a pair of tools. Further, the tool has to be maintained in direct alignment which is again often difficult to do, and is virtually impossible by a single user.

Accordingly, a new and improved method and device for tightening knots around large ropes is needed.

SUMMARY OF THE INVENTION

A preferred embodiment of the line knot tightening tool of this invention has a pair of handles with extended length which are connected together. Each handle comprises a rod-type member with a user grip at one end and a head portion at the other end. The head portion has a flat surface on which a gripper device is positioned for gripping one end of a flexible line that extends from a knot tied to a rope or houser. A pair of links interconnect the head portions and assure aligned, relative, rotational movement of the handles and the head portions, to the rope. Each of the handles are held in a given plane and are restricted to movement in that plane by the link members, so in rotational movement of the handles and when gripping the flexible ends of the lines, a pulling force on the respective lines in opposite directions tightens the knot around the rope. In this movement, the head portions move away from the rope and do not maintain direct side contact with the rope. This allows the head portions to move a substantial distance from each other, which is required to effectively tighten the knot in one movement of the handles in a rotational direction towards each other. Since the handles are restrained to movement only within the given plane, the handles can be used either by separate users or by a single user, because the handles do not tend to have side movement relative to the rope and remain in the given plane.

When the line knot has been sufficiently tightened, then the respective handles and heads are rotated in the opposite direction, allowing release of the lines. Thus the entire knot tightening operation has been accomplished by a single tool, operated by a single person or jointly by two persons, with the tool maintaining its correct orientation throughout the operation relative to the rope, and the respective lines. This is a marked improvement over the previous knot tightening tools as it is a great labor saver, allows use by a single user, allows tightening the line knot in one gripping operation, does not require continuous contact with the rope during the knot tightening operation, and allows sufficient slack in the line on reverse movement of the handles to facilitate freeing the respective free ends of the line from the gripper devices.

It is therefore an object of this invention to provide a new and improved knot tightening tool for tightening knots secured to large ropes and the like.

It's another object of this invention to provide a new and improved hanging knot tightening tool for use in mending or making fishing nets to which the net is to be attached to the rope by a knotted line.

BRIEF DESCRIPTION OF THE DRAWINGS

The foregoing and other objects and many attended advantages of this invention will become more apparent upon the reading of the following detailed description and an examination of the drawings wherein like reference numerals designate like parts throughout, and in which.

DESCRIPTION OF THE PREFERRED EMBODIMENT

Figure 1:
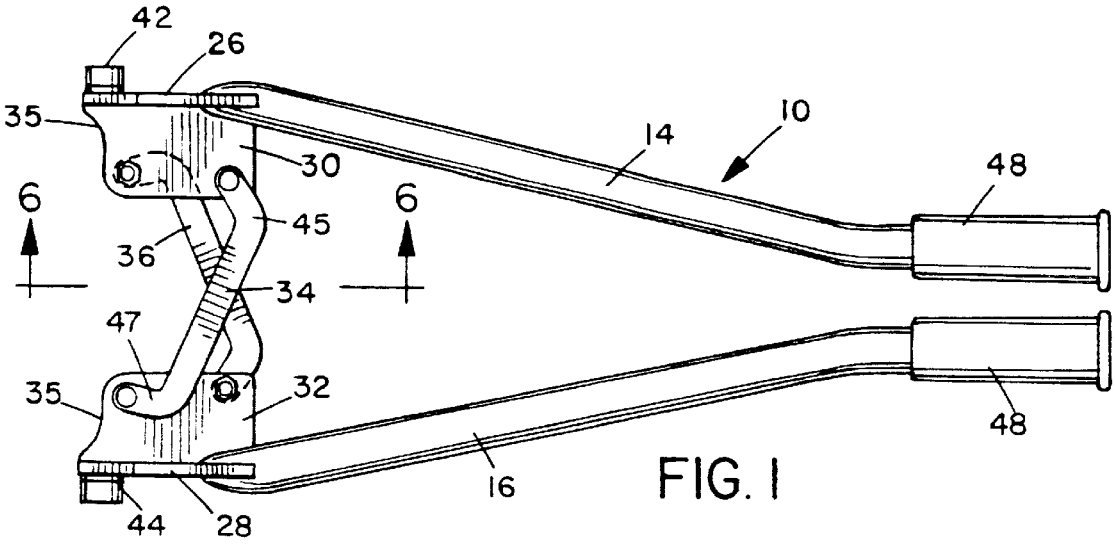
FIG. 1 is a top plan view of the knot tightening tool.
Figure 2:
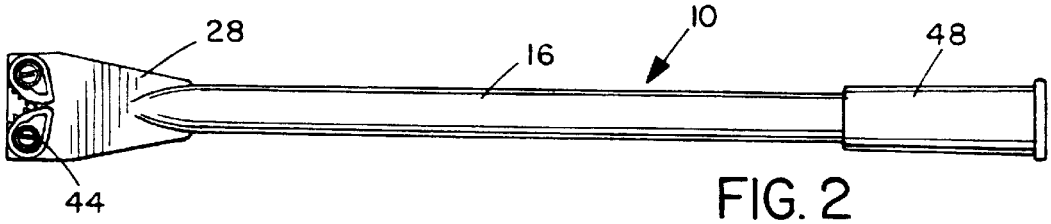
FIG. 2 is a side elevation view of the tool.

An exemplary embodiment of the line knot tightening tool in accordance with the invention as illustrated in FIGS. 1 through 7. Referring now to FIG. 1, tool 10 has a pair of handles 14 and 16 with gripping surfaces 48 at one end and respective head portions 26 on the other end of handle 14 and head portion 28 on the other end of handle 16. The head portions generally comprise flat plates 26 and 28. Ribs 30 and 32 are integral with or connected to the sides of plates 26 and 28, at 90° angles. Positioned on the upper surface of each of the plates 14 and 16 are gripper devices 42 and 44, each of which have a pair of rotatable jaws with gripping teeth, through which line 20, for example, is placed. The gripping device comprises eccentrically arranged teeth that pivot in a known manner to secure line 20 from movement longitudinally relative to the handle 14, see FIG. 2.

Each of the arms 14 and 16 are connected together by a pair of interconnecting links 34 and 36 that are rotatably secured by bolts or the like 38 to the respective ribs 30 and 32. The links have an offset angled construction. The angled portions 45 and 47 are sufficient to allow the links to fit over the bottom of the rope 12 during tightening the knot 18, see FIG. 3. The links function to hold the handles 14 and 16 together, allowing rotational movement between the head portions of each of handles 14 and 16, and also to allow movement in a given plane. The handles 14 and 16 are thus in the given plane and are capable of movement only in the given plane.

Figure 7:
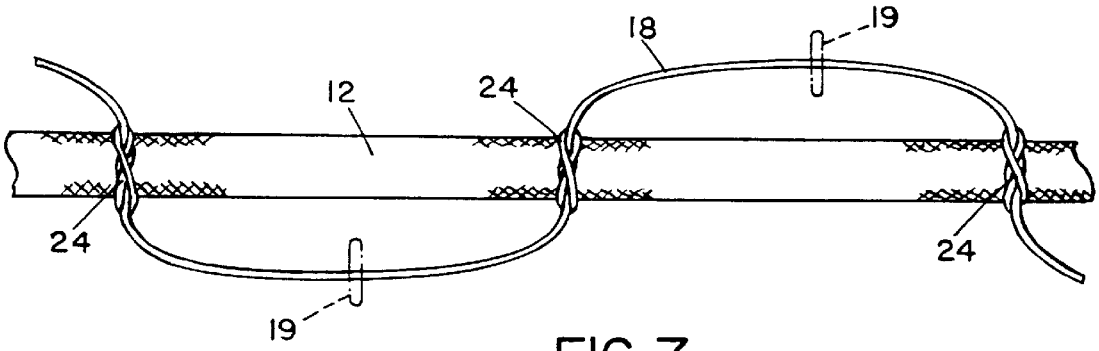
FIG. 7 is a view of a typical rope with a line attached by multiple knots.

A large rope or houser 12, see FIG. 7, is used to support fishing nets. The fishing nets comprise a weave of lines or cords such as in line 18. These fishing nets are connected to the rope 12 by a flexible line 18 which is held in position by a knot 24. The portion of the net that is connected to line 18 is illustrated by element 19. It will be noted that knots 24 are spaced along the lengths of rope 12 with each knot being tied crosswise to the rope 12. Accordingly, the line 18 between knots 24 comprise free lines for grasping and pulling in order to tighten knot 24 to the rope 12.

Figure 3:
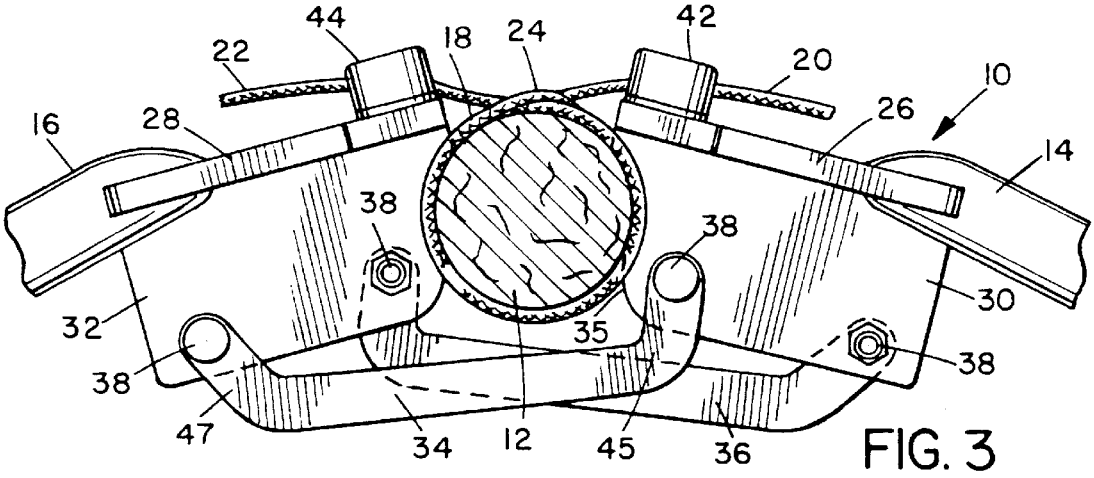
FIG. 3 is an enlarged top plan view of the jaws portion of the tool in the initial knot engaging position.
Figure 4:
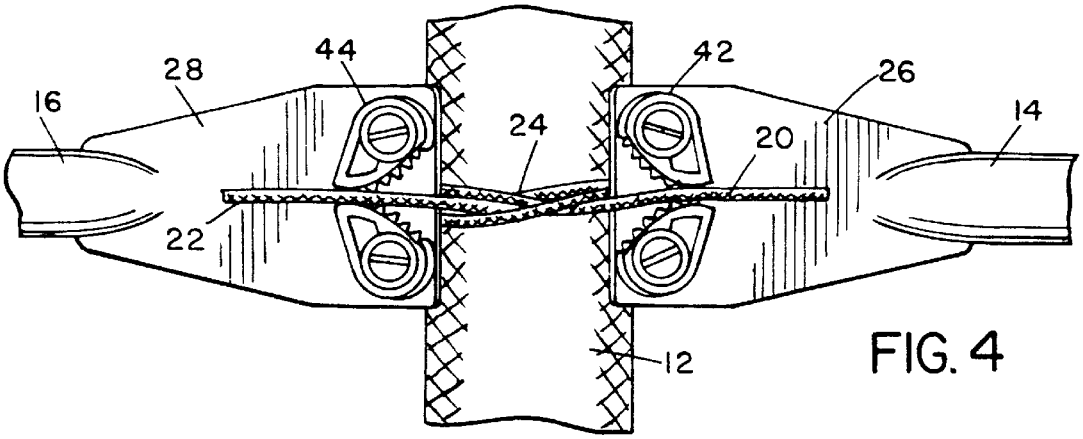
FIG. 4 is a front view of the structure of FIG. 3.
Figure 5:
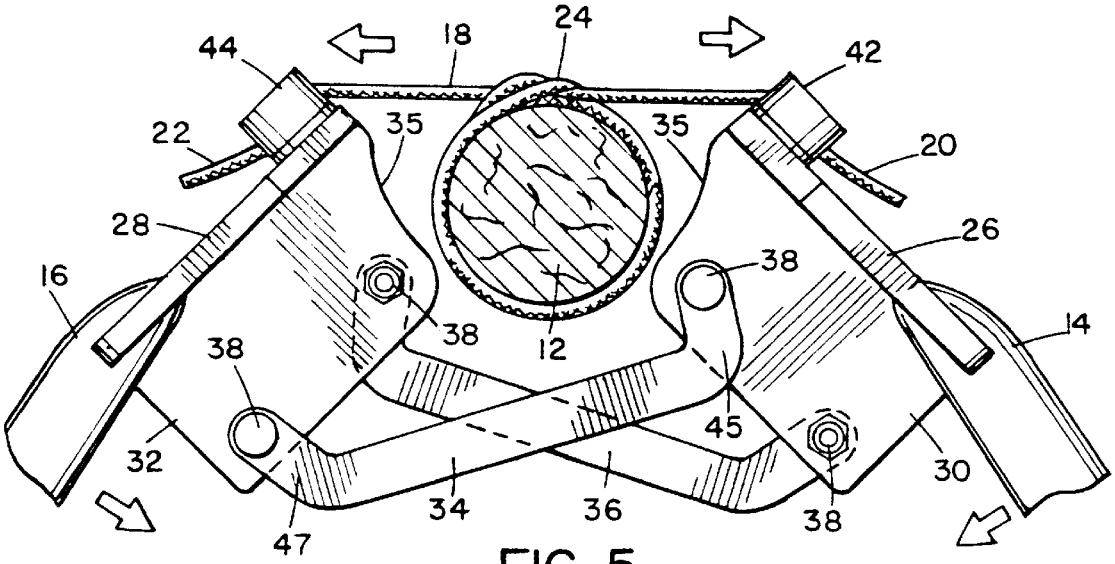
FIG. 5 is a view similar to FIG. 3 with the jaws expanded to tighten the knot.
Figure 6:
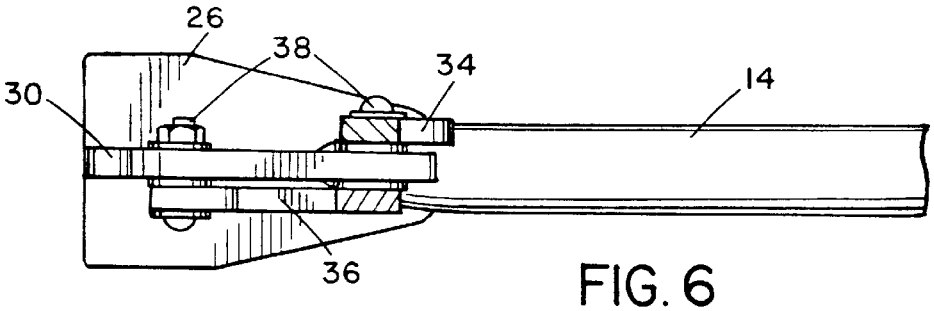
FIG. 6 is an enlarged sectional view taken on line 6—6 of FIG. 1.

Referring to FIGS. 3, 4 and 5, the respective ribs 30 and 32 have end surfaces 35 that are curved to provide a recess for the rope 12. As illustrated in FIG. 3, the knot 24 is tied to the rope 12. Tool 10 is arranged relative to the free lines 20 and 22 with the rope positioned in recess 35 and the links 34 and 36 interconnecting the heads 26 and 28 by the rotating connectors 38. The respective arms 14 and 16 project outwardly from the rope 12. The ends 20 and 22 are placed into the grippers 42 and 44.

IN OPERATION:

When rope 12 and flexible line 18 are arranged as in FIGS. 3 and 4, and the free ends 20 and 22 of the line 18 are placed into the grippers 42 and 44, the respective handles 14 and 16 are then rotated towards each other and toward the rope 12 with handle 14 being rotated clockwise and handle 16 being rotated in a counterclockwise direction. The grippers hold the lines 20 and 22 in place, and with this rotation of the handles 14 and 16, either by a single user or by two users cooperatively operating the handles, knot 24 is tightened. It may be observed that links 34 and 36 are spaced below the rope 12 in the recess created by the sections 45 and 47 of the links.

Upon further rotational movement in the direction of arrows 41, the two gripper devices 42 and 44 move in the direction of arrows 43, pulling on the ends of the cords 20 and 22 and tightening the knot 18. It will be observed in FIG. 5 that in this movement, links 34 and 36 co-act with movement of the handles 14 and 16 to cause the respective ribs 30 and 32 to move away from the rope. This movement is such that grippers 42 and 44 move a sufficient distance so that knot 24 is sufficiently, tightly made with just one movement of handles 14 and 16. It will likewise be observed that the handles 14 and 16 are held in alignment and in a given plane relative to the rope 12. This aids both in joint and single user, use of the tool 10 in tightening knot 24 around the rope 12.

The handles 14 and 16, head portions 26 and 28, and plates 30 and 32 as well as links 34 and 36, all may be made of any suitable strong material such as metals. However, very strong plastics could also be used, or any other suitable material. The lines 18 are generally of cord-type material, but other suitable materials may be also used.

It should further be recognized that these changes may be made in the form, construction and arrangement of the line knot tightening tool as described herein without departing from the spirit and scope of the invention and without sacrificing any of its advantages, and it's understood that all matters herein are to be interpreted as illustrative and not in any limiting sense.

I claim:

1. A knot tightening tool for use in mending or making a fishing net, which net has a large diameter rope to which flexible lines are secured by knots, comprising:

a pair of handles extending outwardly in a plane normal to said rope having adjacent head portions with adjacent head end surfaces facing opposite sides of the rope;

a linkage having opposite, spaced ends interconnecting and spacing said head portions, with each linkage end pivotally connected to each of said heads, permitting spaced pivotal rotational movement of said handles toward each other with said head portions moving away from each other, and a line gripper positioned on each of said heads for receiving and gripping the free portions of the line from the knot, whereby in the movement of said handles, said grippers pull the free ends of the line, tightening the knot.

2. A flexible line knot tightening tool as claimed in claim 1 in which:

said linkage comprises a pair of links with opposite ends and with each opposite end of each link being connected to each head portion, each connection of each of said links to one of said head portions being offset laterally along the length of said handle, whereby movement of said handles causes an increase in the movement of said head portions, for the same movement of said handles.

3. A flexible line knot tightening tool as claimed in claim 1 in which:

said links, each have an offset, length section spaced from the rope that increases the space between said head portions and said linkage around the rope.

4. A flexible knot tightening tool as claimed in claim 2 in which:

each of said head portions has a lower portion comprising a rib to which ends of said linkage are interconnected, one of said links is offset lengthwise from the other link in their respective connections to each of said ribs, whereby pivotal movement of said ribs by pivotal movement of said handles causes said head portion surfaces to move apart from the rope while pivoting.

5. A flexible knot tightening tool as claimed in claim 4 in which:

each of said links being connected to adjacent, opposite sides of said ribs.

* * * * *